US010169945B2

(12) United States Patent
Kojima et al.

(10) Patent No.: US 10,169,945 B2
(45) Date of Patent: Jan. 1, 2019

(54) MEDIUM STORAGE BOX AND MEDIUM HANDLING DEVICE

(71) Applicant: Oki Electric Industry Co., Ltd., Tokyo (JP)

(72) Inventors: Ryousuke Kojima, Tokyo (JP); Yuusuke Yamashita, Tokyo (JP); Hirokazu Komatsu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/556,430

(22) PCT Filed: Dec. 2, 2015

(86) PCT No.: PCT/JP2015/083921

§ 371 (c)(1),
(2) Date: Sep. 7, 2017

(87) PCT Pub. No.: WO2016/147495

PCT Pub. Date: Sep. 22, 2016

(65) Prior Publication Data

US 2018/0108200 A1 Apr. 19, 2018

(30) Foreign Application Priority Data

Mar. 17, 2015 (JP) ..... 2015-053227

(51) Int. Cl.
*G07D 11/00* (2006.01)
*B65H 1/26* (2006.01)
(Continued)

(52) U.S. Cl.
CPC ..... *G07D 11/0012* (2013.01); *B65H 1/26* (2013.01); *B65H 29/22* (2013.01); *B65H 31/24* (2013.01);
(Continued)

(58) Field of Classification Search
CPC ..... G07D 11/0006; G07D 11/0009; G07D 11/0018; G07D 11/0012; B65H 2405/20; B65H 2405/21
See application file for complete search history.

(56) References Cited

U.S. PATENT DOCUMENTS 4,275,667 A * 6/1981 Hilton ..... G07D 11/0009 109/39
4,603,847 A * 8/1986 Oota ..... G07D 11/0009 221/151

(Continued)

FOREIGN PATENT DOCUMENTS

JP S63-27246 Y2 7/1988
JP H08-263719 A 10/1996

*Primary Examiner* — Jeremy R Severson
(74) *Attorney, Agent, or Firm* — Rabin & Berdo, P.C.

(57) ABSTRACT

A medium storage box includes an internal storage space configured to store a paper sheet-shaped medium. The medium storage box includes: a first opening into which an insertion member is inserted from outside; a second opening through which the medium passes; a first shutter member that closes off the first opening; a second shutter member that closes off the second opening; and a biasing mechanism that biases either the first shutter member, or the second shutter member, or both, in a closing direction. The first shutter member is configured to be pressed by the insertion member and moves in an opening direction during insertion of the insertion member, such that a portion of the first shutter member abuts the second shutter member and moves the second shutter member in an opening direction.

7 Claims, 9 Drawing Sheets

(51) Int. Cl.

| | |
|---|---|
| ***G07D 9/00*** | (2006.01) |
| ***B65H 29/22*** | (2006.01) |
| ***B65H 31/24*** | (2006.01) |

(52) U.S. Cl.

CPC ..... *G07D 9/00* (2013.01); *G07D 11/0018* (2013.01); *G07D 11/0084* (2013.01); *B65H 2405/21* (2013.01); *B65H 2701/1912* (2013.01); *G07D 11/0009* (2013.01); *G07D 2211/00* (2013.01)

(56) References Cited

U.S. PATENT DOCUMENTS

| | | | | | |
|---|---|---|---|---|---|
| 4,798,316 | A * | 1/1989 | Martin | B65H 1/12 | 232/1 D |
| 4,854,570 | A * | 8/1989 | Martin | B65H 1/12 | 271/162 |
| 8,196,919 | B2 * | 6/2012 | Copestake | E05B 65/0075 | 109/23 |

* cited by examiner

MEDIUM STORAGE BOX AND MEDIUM HANDLING DEVICE

TECHNICAL FIELD

This application claims priority from Japanese Patent Application No. 2015-053227, filed Mar. 17, 2015, the disclosure of which is incorporated in its entirety by reference herein.

The present disclosure relates to a medium storage box including an internal storage space for storing a paper sheet-shaped medium, and to a medium handling device loaded with the medium storage box.

BACKGROUND ART

Cash handling devices that handle cash are a conventional type of medium handling device that handles a medium. Medium storage boxes are loaded inside the cash handling device (see, for example, Japanese Patent Application Laid-Open (JP-A) No. H08-263719). Medium storage boxes are box-shaped storages for internally storing a paper sheet-shaped medium. Medium storage boxes are often configured as a cassette unit that is attachable to and detachable from a cash handling device so as to be capable of being transported in a state detached from the device.

It is necessary to protect internal mechanisms of such medium storage boxes such that the internal mechanisms are not damaged during transportation. It is also necessary to ensure security such that that the medium stored inside the medium storage box is not removed therefrom during transportation.

Thus, conventional medium storage boxes are configured such that both an opening provided in order to access a mechanism (drive transmission section) for feeding out a medium to a medium handling device, and an opening provided to a location (a medium-passing section) for passing the medium to the medium handling device, are closed at once by a single, comparatively large shutter member.

Note that there are conventional medium storage boxes that are configured such that the shutter member opens manually, and that are configured such that the shutter member opens automatically. If opened manually, the conventional medium storage box is configured such that the shutter member is opened manually after an operator has loaded the medium into the medium storage box. If opened automatically, the conventional medium storage box is configured such that a dedicated fixing member is provided inside the medium handling device in order to open the shutter member, or is configured such that a dedicated actuator is provided inside the medium handling device or the medium storage box in order to open the shutter member.

SUMMARY OF INVENTION

Technical Problem

As explained below, it is desirable to increase the rigidity of casing in conventional medium storage boxes.

For example, in conventional medium storage boxes, since the shutter member is comparatively large, the thickness of casing surrounding the shutter member is thinner, and it is difficult to increase the rigidity of the casing. There is accordingly a possibility in conventional medium storage boxes that the casing might be damaged if an impact is received when the medium storage box is dropped, for example. It is therefore desirable to increase the rigidity of the casing in conventional medium storage boxes.

In consideration of the above circumstances, the present disclosure provides a medium storage box in which the rigidity of a casing is increased, and a medium handling device loaded with the medium storage box.

Solution to Problem

A first aspect of the present disclosure is a medium storage box including an internal storage space configured to store a paper sheet-shaped medium, the medium storage box including: a first opening into which an insertion member is inserted from outside; a second opening through which the medium passes; a first shutter member that closes off the first opening; a second shutter member that closes off the second opening; and a biasing mechanism that biases either the first shutter member, or the second shutter member, or both, in a closing direction, wherein the first shutter member is configured to be pressed by the insertion member and moving in an opening direction during insertion of the insertion member, such that a portion of the first shutter member abuts the second shutter member and moves the second shutter member in an opening direction.

This medium storage box is configured such that the first opening and the second opening are closed off by the two shutter members rather than both being closed off at once by a single, comparatively large, shutter member. In this medium storage box, the respective shutter members may be made smaller by making the areas of the respective openings smaller. Thus, the medium storage box enables the rigidity of the casing to be raised.

A second aspect of the present disclosure is a medium handling device that handles a medium. The medium handling device is loaded with the medium storage box of the first aspect, and includes and a conveyor mechanism that conveys the medium.

Effects of Invention

The first aspect is capable of providing a medium storage box with increased casing rigidity.

Moreover, the second aspect is capable of providing a medium handling device loaded with the medium storage box according to the first aspect.

DESCRIPTION OF EMBODIMENTS

Figure 1:
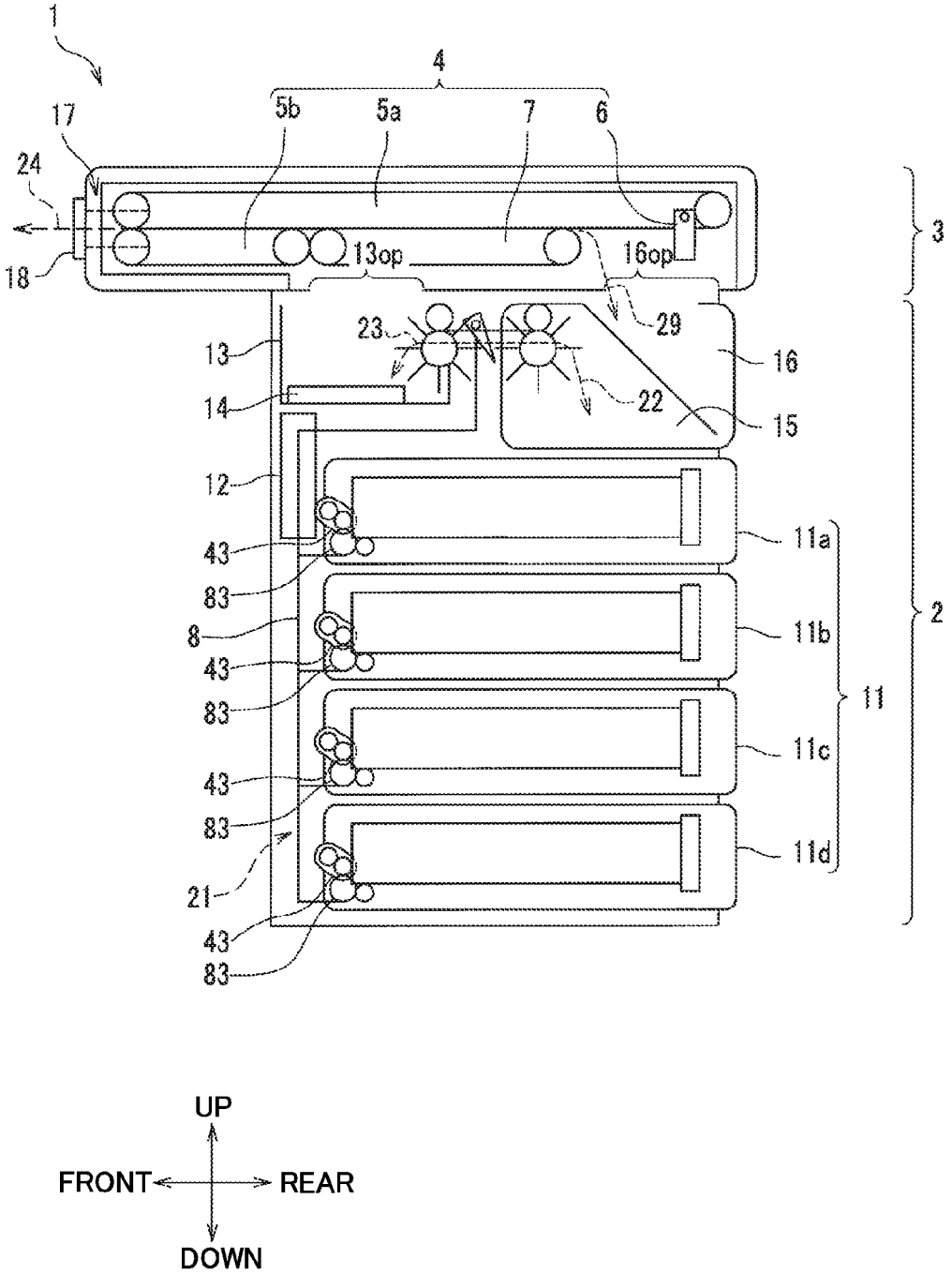
FIG. 1 is a diagram illustrating a configuration of a medium handling device loaded with medium storage boxes according to a first exemplary embodiment.

Detailed explanation follows regarding exemplary embodiments of the present disclosure, with reference to the drawings. Note that each of the drawings is merely an outline illustration to enable sufficient understanding of the present disclosure. Thus, the present disclosure is not limited to the illustrated examples. In each of the drawings, common configuration elements and similar configuration elements are appended with the same reference numerals and duplicate explanation thereof is omitted.

Figure 2:
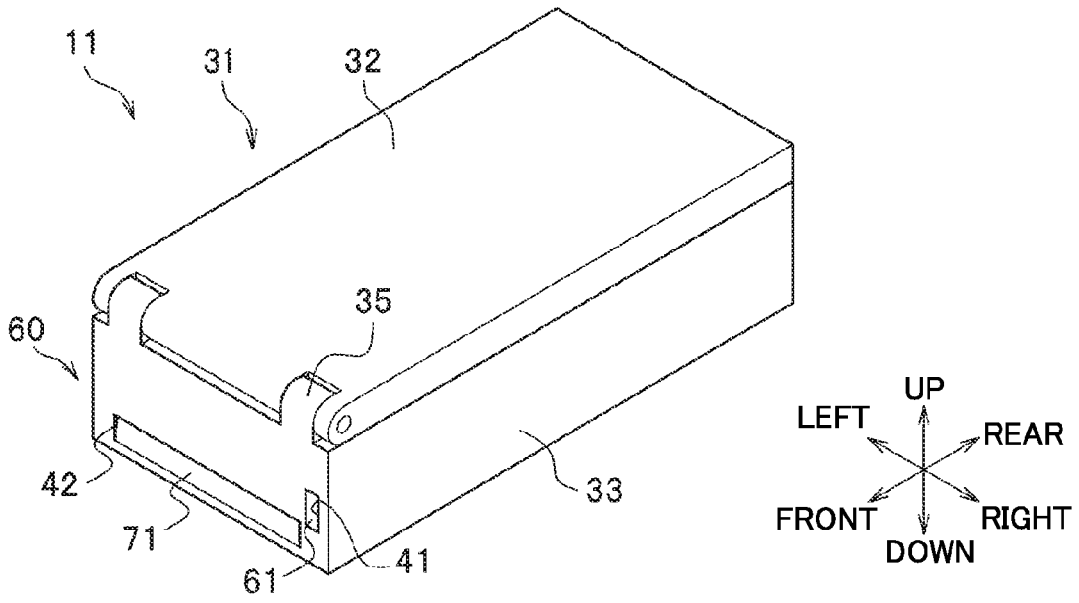
FIG. 2 is a diagram illustrating a configuration of the exterior of a medium storage box according to the first exemplary embodiment.

Note that the respective "front", "rear", "right", and "left" directions referred to herein indicate directions when an operator handling a medium storage box 11 according to a first exemplary embodiment views the medium storage box 11 as illustrated in FIG. 2. The respective directions may be changed as appropriate according to the operation of the medium storage box 11.

First Exemplary Embodiment

Configuration of Medium Handling Device Loaded with Medium Storage Boxes

Explanation follows regarding a configuration of a medium handling device 1 loaded with medium storage boxes 11 according to the first exemplary embodiment, with reference to FIG. 1. FIG. 1 is a diagram illustrating a configuration of the medium handling device 1.

The medium handling device 1 is, for example, a cash dispenser (CD), an automatic teller machine (ATM), or the like. Note that the following explanation envisages a case in which the medium handling device 1 is a cash dispenser (CD). Moreover, explanation follows in which the medium is banknotes.

As illustrated in FIG. 1, the medium handling device 1 includes a storage unit 2 that stores banknotes, and a bundle conveyance unit 3 that conveys banknote bundles. The storage unit 2 includes a conveyor path 8, medium storage boxes 11, a classification section 12, a stacking section 13, a reject storage box 15, and an intake storage box 16. The bundle conveyance unit 3 includes a conveyor mechanism 4, an upper belt 5*a*, a lower belt 5*b*, a Russell plate (board) 6, a movable conveyor belt 7, a pay-out port 17, and a shutter 18.

The conveyor path 8 is a path on which banknotes are conveyed. A conveyor mechanism (not illustrated in the drawings) that conveys banknotes is disposed in the vicinity of the conveyor path 8. The medium storage boxes 11 are storage boxes for storing banknotes. The classification section 12 is a device that classifies the denomination, the quantity, the eligibility for pay-out, and so on, of banknotes. The stacking section 13 is a location where banknotes conveyed from the medium storage boxes 11 are stacked. The reject storage box 15 is a storage box that stores banknotes (reject banknotes) conveyed from the medium storage boxes 11 that have been classified as banknotes unsuitable for pay-out by the classification section 12. The intake storage box 16 is a storage box that stores banknotes that have been left in the pay-out port 17 for a specific duration or greater. The pay-out port 17 is a location where banknotes are dispensed to the exterior of the medium handling device 1. The shutter 18 is a member that selectively opens or closes the pay-out port 17.

The upper belt 5*a* and the lower belt 5*b* are members that sandwich banknotes in the up-down direction and convey these banknotes. The Russell plate 6 is a member that pushes banknotes forward by moving forward from a position that is further rearward than a rear end of the banknotes. The movable conveyor belt 7 is a member that conveys banknotes, as well as selectively opening and closing an opening 13*op* provided above the stacking section 13 and an opening 16*op* provided above the intake storage box 16 by moving along the front-rear direction.

The medium handling device 1 includes a pay-out route 21, a reject route 22, a stacking route 23, a dispensing route 24, and an intake route 29 as banknote conveyance routes. The pay-out route 21 is a route linking the respective medium storage boxes 11 to the pay-out port 17. The reject route 22 is a route linking a position between the stacking section 13 and the reject storage box 15 to the reject storage box 15. The stacking route 23 is a route linking the position between the stacking section 13 and the reject storage box 15 to the stacking section 13. The dispensing route 24 is a route linking a position between the upper belt 5*a* and the lower belt 5*b* to the pay-out port 17. The intake route 29 is a route linking the pay-out port 17 to the intake storage box 16.

In the first exemplary embodiment, the medium handling device 1 is loaded with four of the medium storage boxes 11. Note that the following explanation envisages a case in which the medium handling device 1 is a rear-face maintenance device, and the medium storage boxes 11 are mounted in the medium handling device 1 by being pressed into the medium handling device 1 from a rear face side of the medium handling device 1. In the following, in cases in which a distinction is made below between the four medium storage boxes 11, they are referred to as medium storage boxes 11*a*, 11*b*, 11*c*, and 11*d* in sequence from the top.

Note that this explanation envisages a case in which the medium storage boxes 11 are "horizontal-storage medium storage boxes". The "horizontal-storage medium storage boxes" refers to medium storage boxes configured such that banknotes are stored superimposed on each other in the front-rear direction in a state in which the short sides (or long sides) of the banknotes are made to stand in the up-down direction.

In the first exemplary embodiment, the reject storage box 15 and the intake storage box 16 are configured by a single storage box. Namely, in the medium handling device 1, the interior of a single storage box is divided into two spaces; one space being employed as the reject storage box 15 and the other space being employed as the intake storage box 16.

In the first exemplary embodiment, the stacking section 13 and the reject storage box 15 are disposed adjacent to each other. The conveyor path 8 is formed from a position in front of the lowest medium storage box 11*d*, then passes in front of the medium storage boxes 11*c*, 11*b*, and 11*a* and through the inside the classification section 12, before arriving at a position between the stacking section 13 and the reject storage box 15. The conveyor path 8 branches toward the stacking section 13 side and toward the reject storage box 15 side at the position between the stacking section 13 and the reject storage box 15.

The upper belt 5*a* and the lower belt 5*b* each run driven by a non-illustrated drive mechanism. The Russell plate 6 and the movable conveyor belt 7 similarly move driven by a non-illustrated drive mechanism. The drive mechanisms that drive these members may have the same drive source, or may have different drive sources.

The upper belt 5*a* and the movable conveyor belt 7 are disposed facing each other in the up-down direction, and their respective facing portions are disposed so as to be in close contact with each other. The upper belt 5*a* and the lower belt 5*b* are also disposed facing each other in the up-down direction, and their respective facing portions are disposed so as to be in close contact with each other. The Russell plate 6 and the movable conveyor belt 7 are each formed in a shape that avoids the other, such they do not collide with each other when the Russell plate 6 or the movable conveyor belt 7 is moved.

The length of the upper belt 5*a* is longer than the combined length of the movable conveyor belt 7 and the lower belt 5*b*. The upper belt 5*a* is stretched between a roller pair respectively provided in the vicinity of a front end and in the vicinity of a rear end of the medium handling device 1. One roller of the roller pair between which the upper belt 5*a* is stretched is a drive roller that rotates so as to drive the upper belt 5*a*, and the other roller is a following roller that rotates following the movement of the upper belt 5*a*. The movable conveyor belt 7 is stretched between a roller pair respectively provided toward the front side and the rear side of the medium handling device 1. Note that explanation follows envisaging a case in which one roller of the roller pair between which the movable conveyor belt 7 is stretched is a drive roller and the other roller is a following roller. However, both rollers of the roller pair between which the movable conveyor belt 7 is stretched may be following rollers. The lower belt 5*b* is stretched between a roller pair respectively provided in the vicinity of the front end of the medium handling device 1 and in the vicinity of the front of the opening 13*op*. Note that explanation follows envisaging a case in which one roller of the roller pair between which the lower belt 5*b* is stretched is a drive roller and the other roller is a following roller. However, both rollers of the roller pair between which the lower belt 5*b* is stretched may be following rollers.

The first exemplary embodiment is explained envisaging a case in which the medium handling device 1 includes external gear mechanisms 43 and a non-illustrated motor for driving each external gear mechanism 43, and each medium storage box 11 is configured including an internal gear mechanism 83.

Each external gear mechanism 43 is a mechanism for driving the respective internal gear mechanism 83. Each external gear mechanism 43 is disposed in mounting section formed inside the medium handling device 1 for each medium storage box 11 so as to correspond to the respective medium storage box 11. Each internal gear mechanism 83 is a mechanism for driving a non-illustrated separation section that separates banknotes stored inside the respective medium storage box 11 one by one and that feeds out the banknotes to the conveyor path 8.

When a medium storage box 11 is mounted in the medium handling device 1, a rear end portion of the corresponding external gear mechanism 43 is inserted into the medium storage box 11 through a first opening 41 (see FIG. 2), described later. The external gear mechanism 43 and the internal gear mechanism 83 are thereby coupled together. The medium handling device 1 drives the non-illustrated motor during pay-out. Drive force of the non-illustrated motor is transmitted to the internal gear mechanism 83 through the external gear mechanism 43. The non-illustrated separation section is thereby driven and banknotes stored inside the medium storage box 11 are fed out in sequence to the conveyor path 8.

In the first exemplary embodiment, the non-illustrated motor is moved from the medium storage box 11 to the medium handling device 1 by configuring the medium handling device 1 and each medium storage box 11 in the above manner. Thus, the first exemplary embodiment enables a decrease in the weight of the medium storage box 11 commensurate with the weight of the motor, and enables an improvement in the degrees of freedom for the design of the medium storage box 11 commensurate to the space taken up by the motor.

In the above configuration, the medium handling device 1 operates in the following manner during pay-out. First, the medium handling device 1 sequentially feeds out banknotes of a desired denomination from inside the medium storage box 11 holding this denomination to the conveyor path 8 according to an instruction from an operator, and conveys the fed-out banknotes along the pay-out route 21 to a position between the stacking section 13 and the reject storage box 15, classifying the banknotes in the classification section 12 en route.

The medium handling device 1 then conveys any banknotes (reject banknotes) classified as unsuitable for pay-out by the classification section 12 along the reject route 22 toward the reject storage box 15 side and stores these banknotes inside the reject storage box 15. The medium handling device 1 also conveys banknotes classified as suitable for pay-out by the classification section 12 along the stacking route 23 toward the stacking section 13 side and stores these banknotes inside the stacking section 13.

A stage 14 for stacking banknotes is disposed inside the stacking section 13. After a bundle of a desired quantity of banknotes has been stacked, the medium handling device 1 raises the stage 14. When this is performed, the movable conveyor belt 7 is moved to a position that opens the opening 13*op* in coordination with the raising of the stage 14. The Russell plate 6 retreats to a position where there is no contact with the banknotes.

After the stage 14 has been raised, the medium handling device 1 causes the upper belt 5*a* and the lower belt 5*b* to run and also moves the Russell plate 6 forward from a position that is further rearward than the rear end of the banknotes, such that the Russell plate 6 that was positioned further rearward than the rear end of the banknotes moves the banknote bundle stacked on the stage 14 forward. Thus, in the medium handling device 1, the banknote bundle is conveyed forward along the dispensing route 24 by the conveyor mechanism of the upper belt 5*a* and the movable conveyor belt 7, as well as the conveyor mechanism of the upper belt 5*a* and the lower belt 5*b*, while the banknote bundle is being pushed forward by the Russell plate 6.

The banknote bundle moves from above the stage 14 onto the movable conveyor belt 7 when this is performed. The banknote bundle then passes between the upper belt 5*a* and the movable conveyor belt 7, passes between the upper belt 5*a* and the lower belt 5*b*, and is conveyed to a position near the pay-out port 17.

After the banknote bundle has been conveyed to the position near the pay-out port 17, the medium handling device 1 opens the shutter 18 and runs the upper belt 5*a* and the lower belt 5*b*. The medium handling device 1 thereby conveys the banknote bundle forward. Part of the banknote bundle thereby adopts a state projecting out from the pay-out port 17 to the exterior. A customer is thereby able to take the banknote bundle from the medium handling device 1.

After the medium handling device 1 detects that the customer has taken the banknote bundle, the medium handling device 1 closes the shutter 18 and enters a state capable of responding to the next transaction.

However, when the banknote bundle is left in the pay-out port 17 for a specific duration or greater without the banknote bundle being taken by the customer, the medium handling device 1 moves the movable conveyor belt 7 forward and opens the opening 16*op*, and runs the upper belt 5*a* and the lower belt 5*b* such that the banknote bundle moves rearward. Thus, the medium handling device 1 takes the banknote bundle into the device interior along the intake route 29 and stores the banknotes that have been taken in inside the intake storage box 16. The medium handling device 1 then closes the shutter 18 and enters a state capable of responding to the next transaction.

Configuration of Medium Storage Box Exterior

Explanation follows regarding configuration of the exterior of the medium storage box 11, with reference to FIG. 2. FIG. 2 is a diagram illustrating configuration of the exterior of the medium storage box 11. The medium storage box 11 is a case-shaped storage box for storing a paper sheet-shaped medium (banknotes in this case) therein.

As illustrated in FIG. 2, a casing 31 of the medium storage box 11 is formed in a box shape. The casing 31 includes a lid portion 32 and a container portion 33. The lid portion 32 is an upper member configuring the upper side of the casing 31. The lid portion 32 covers an upper portion of the container portion 33. The container portion 33 is a lower member configuring the lower side of the casing 31. The container portion 33 has an internal storage space, and the paper sheet-shaped medium (banknotes in this case) is stored inside the storage space.

The lid portion 32 is attached to the container portion 33 by a swing pivot point 35 so as to be capable of swinging. The lid portion 32 opens and closes by swinging about the swing pivot point 35.

The first opening 41 and a second opening 42 are formed in a front end portion of the medium storage box 11. The first opening 41 is an opening provided in order to access a mechanism (a drive transmission section) for feeding out the medium (banknotes) to the medium handling device 1. An insertion member is inserted into the first opening 41 from the outside. The first exemplary embodiment is explained envisaging a case in which the insertion member is the external gear mechanism 43 (see FIG. 1). The second opening 42 is an opening provided at a location (a medium passing section) for passing the medium (banknotes) to the medium handling device 1. The paper sheet-shaped medium (banknotes in this case) is passed through the second opening 42.

In the example illustrated in FIG. 2, the second opening 42 is disposed in the vicinity of the bottom of the container portion 33. The first opening 41 is disposed at a position at the diagonal upper right of the second opening 42.

The medium storage box 11 includes a shutter mechanism 60 for closing the first opening 41 and the second opening 42. The shutter mechanism 60 includes a first shutter member 61, a second shutter member 71, and a biasing mechanism (biasing members 81, 82 (see FIG. 6A)).

The first shutter member 61 is a member that closes off the first opening 41. The second shutter member 71 is a member that closes off the second opening 42. The biasing mechanism is a mechanism that biases either one or both of the first shutter member 61 and the second shutter member 71 in a closing direction. Note that explanation follows in which the shutter mechanism 60 includes the biasing members 81, 82 (see FIG. 6A) as the biasing mechanism. The biasing member 81 (see FIG. 6A) is a member such as a spring that biases the first shutter member 61 in the closing direction. The biasing member 82 (see FIG. 6A) is a member such as a spring that biases the second shutter member 71 in the closing direction.

Configuration is made such that during insertion of the insertion member (the external gear mechanism 43 in this case), the first shutter member 61 is pressed and moved in an opening direction by the insertion member (specifically, by a non-illustrated bracket supporting the respective gears of the external gear mechanism 43), such that a part of the first shutter member 61 abuts the second shutter member 71 so as to move the second shutter member 71 in the opening direction. Note that "during insertion of the insertion member" refers to when the medium storage box 11 is being mounted in the medium handling device 1.

Configuration of Medium Storage Box Shutter Mechanism

Figure 3:
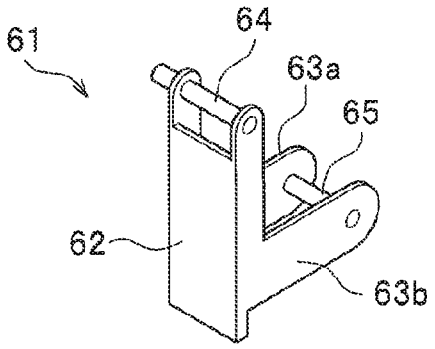
FIG. 3 is a diagram (1) illustrating a configuration of a shutter mechanism of the medium storage box according to the first exemplary embodiment.
Figure 4:
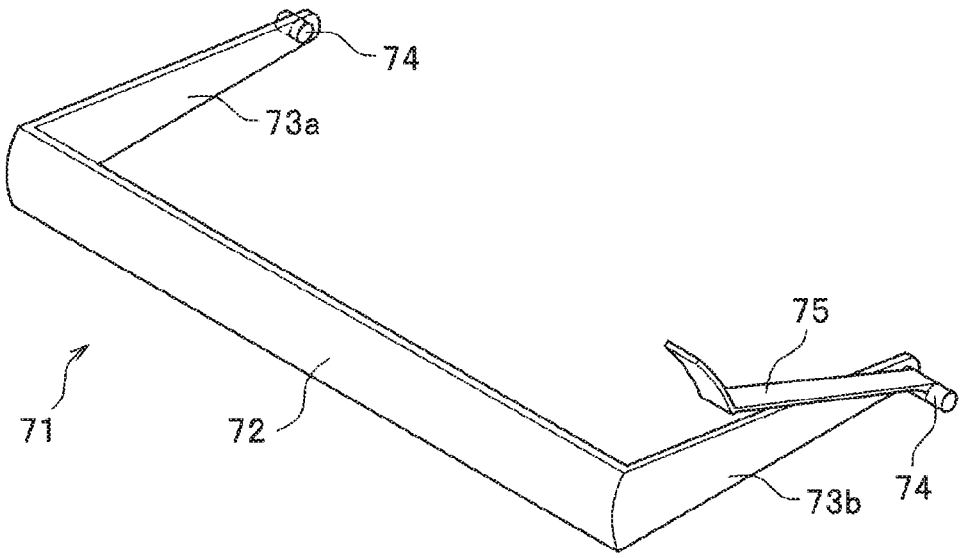
FIG. 4 is a diagram (2) illustrating a configuration of the shutter mechanism of the medium storage box according to the first exemplary embodiment.
Figure 5:
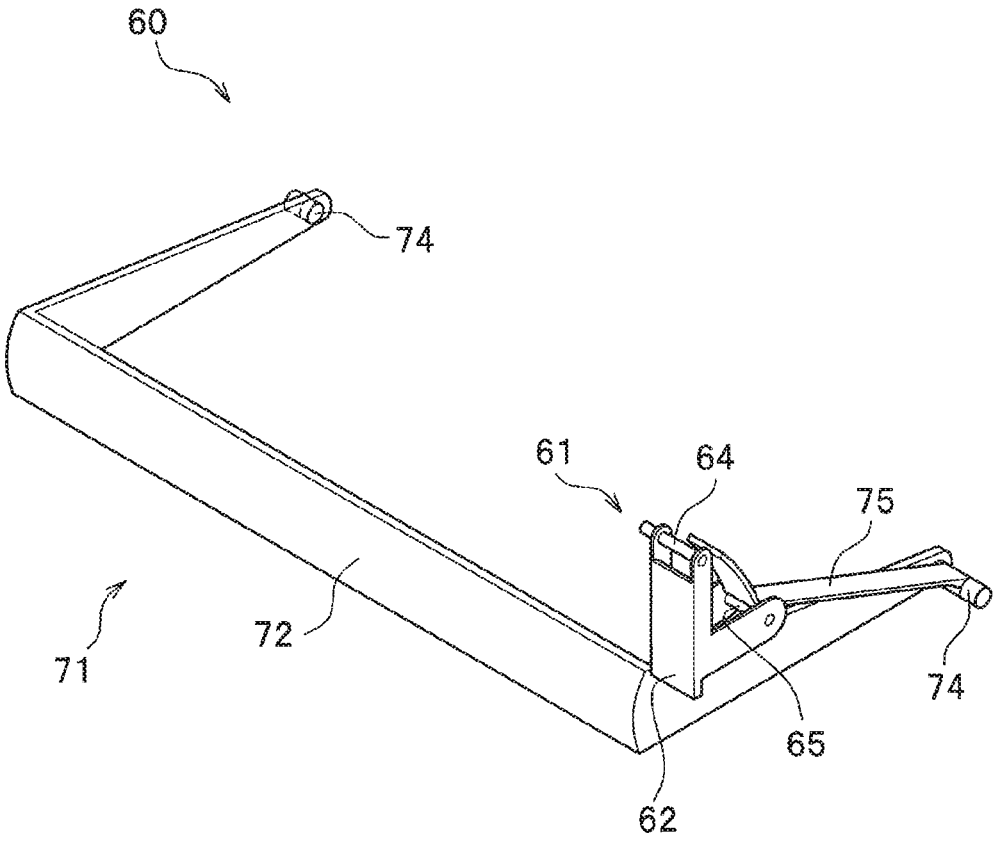
FIG. 5 is a diagram (3) illustrating a configuration of the shutter mechanism of the medium storage box according to the first exemplary embodiment.

Explanation follows regarding configuration of the shutter mechanism 60 of the medium storage box 11, with reference to FIG. 3 to FIG. 5. FIG. 3 to FIG. 5 are respectively diagrams illustrating the configuration of the shutter mechanism 60 of the medium storage box 11. FIG. 3 illustrates configuration of the first shutter member 61 of the shutter mechanism 60. FIG. 4 illustrates configuration of the second shutter member 71 of the shutter mechanism 60. FIG. 5 illustrates a placement relationship of the first shutter member 61 and the second shutter member 71.

As illustrated in FIG. 3, the first shutter member 61 includes a first swing pivot point 64, a first closing face 62, and a first abutting portion 65. The first swing pivot point 64 is a location about which the first shutter member 61 swings. The first closing face 62 is a location that closes off the first opening 41. The first abutting portion 65 is a location that abuts the second shutter member 71.

The first shutter member 61 is configured such that the first closing face 62 is disposed so as to close off the first opening 41 from the inside of the medium storage box 11, with the first swing pivot point 64 disposed substantially horizontally at a position in the vicinity of an upper end portion of the first closing face 62, and with the first abutting portion 65 disposed so as to project out from the vicinity of a lower end portion of the first closing face 62 toward the inside of the medium storage box 11.

In the first exemplary embodiment, a front face of the first closing face 62 is formed in a planar face shape, such that the first closing face 62 may close off the first opening 41 by swinging at the rear of the first opening 41. The first closing face 62 is supported by two support portions 63*a*, 63*b* respectively formed on both sides thereof so as to be capable of swinging about the first swing pivot point 64. The two support portions 63*a*, 63*b* each include a projection portion projecting out from the first closing face 62 toward the inside of the medium storage box 11, and are each formed in a substantially L-shape (or a substantially T-shape) in side-on view. The first swing pivot point 64 is disposed in the vicinity of upper end portions of the two support portions 63*a*, 63*b*. The first abutting portion 65 is disposed in the vicinity of end portions of the projection portions of the two support portions 63*a*, 63*b*.

As illustrated in FIG. 4, the second shutter member 71 includes second swing pivot points 74, a second closing face 72, and a second abutting portion 75. The second swing pivot points 74 are locations about which the second shutter member 71 swings. The second closing face 72 is a location that closes off the second opening 42. The second abutting portion 75 is a location that abuts the first shutter member 61.

The second shutter member 71 is configured such that the second closing face 72 is disposed so as to close off the second opening 42 from inside the medium storage box 11, with the second swing pivot points 74 disposed substantially horizontally at positions inside the medium storage box 11, and with the second abutting portion 75 disposed so as to intersect a swing trajectory L65 (see FIG. 6C) of the first abutting portion 65 about the first swing pivot point 64.

In the first exemplary embodiment, a front face of the second closing face 72 is formed in the shape of a plane curved in a circular arc shape in side-on view, such that the second opening 42 may be closed off by the second closing face 72 swinging inside the second opening 42. The second closing face 72 is disposed at a position alongside (in the first exemplary embodiment, at the diagonal lower left of) the second abutting portion 75, and at a position separated from the second swing pivot points 74. The second closing face 72 is supported by two support portions 73*a*, 73*b* respectively formed on both sides thereof so as to be capable of swinging about the second swing pivot points 74. The two support portions 73*a*, 73*b* each have an elongated configuration formed in a fan shape in side-on view. The two support portions 73*a*, 73*b* are disposed so as to extend along the direction along which the second abutting portion 75 extends, or along a direction close to this direction.

The second swing pivot points 74 are disposed in the vicinity of rear end portions of the two support portions 73*a*, 73*b*. The second abutting portion 75 is configured integrally to the support portion 73*b* on the right side of the second closing face 72. The second abutting portion 75 has a shape including an elongated lower face extending in one direction from the second swing pivot point 74. The "one direction" described herein is a diagonal front-rear direction, set such that the front side is higher than the rear side. The lower face of the second abutting portion 75 is configured so as to curve (or bend) upward in the vicinity of an end portion on the side nearest to the second closing face 72. Note that, as illustrated in FIG. 6C, explanation envisages a case in which the lower face of the second abutting portion 75 is configured so as to curve upward in a circular arc shape along the swing trajectory L65 of the first abutting portion 65 in the vicinity of the end portion on the side nearest to the second closing face 72.

As illustrated in FIG. 5, the first shutter member 61 and the second shutter member 71 are disposed such that the first abutting portion 65 faces the lower face of the second abutting portion 75. In this configuration, when the insertion member (the external gear mechanism 43 in this case) is inserted into the first shutter member 61, the first closing face 62 is pressed by the insertion member (specifically, by the non-illustrated bracket supporting the respective gears of the external gear mechanism 43) and swings about the first swing pivot point 64. Thus, the first shutter member 61 causes the first abutting portion 65 to abut the second abutting portion 75, enabling the second shutter member 71 to be swung in the opening direction about the second swing pivot points 74.

Operation of Medium Storage Box Shutter Mechanism

Explanation follows regarding operation of the shutter mechanism 60 of the medium storage box 11, with reference to FIG. 6A to FIG. 6D. FIG. 6A to FIG. 6D are respectively drawings schematically illustrating operation of the shutter mechanism 60 of the medium storage box 11.

Figure 6A:
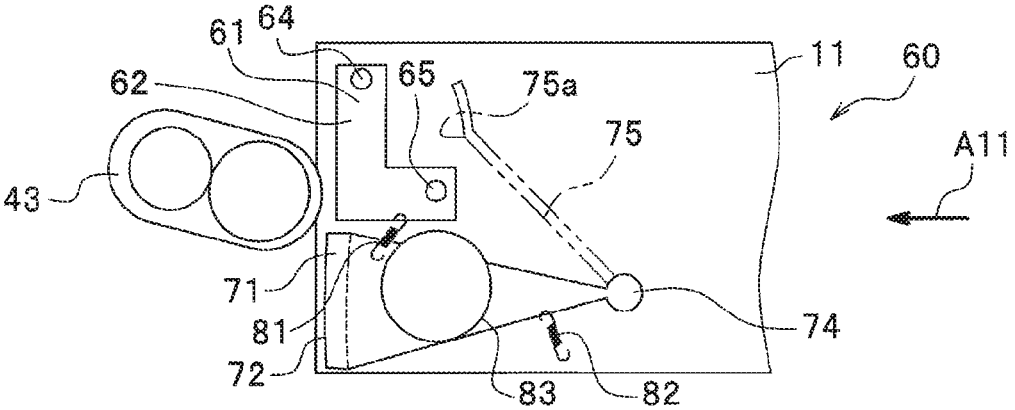
FIG. 6A is a diagram schematically illustrating operation of the shutter mechanism of the medium storage box according to the first exemplary embodiment.

As illustrated in FIG. 6A, when an operator pushes the medium storage box 11 into the medium handling device 1 (see FIG. 1) from the rear face side of the medium handling device 1, the medium storage box 11 moves (see arrow A11). The medium storage box 11 is thereby mounted in the medium handling device 1. The external gear mechanism 43, serving as the insertion member of the medium handling device 1, is inserted into the medium storage box 11 through the first opening 41 (see FIG. 2) when this is performed.

Figure 6B:
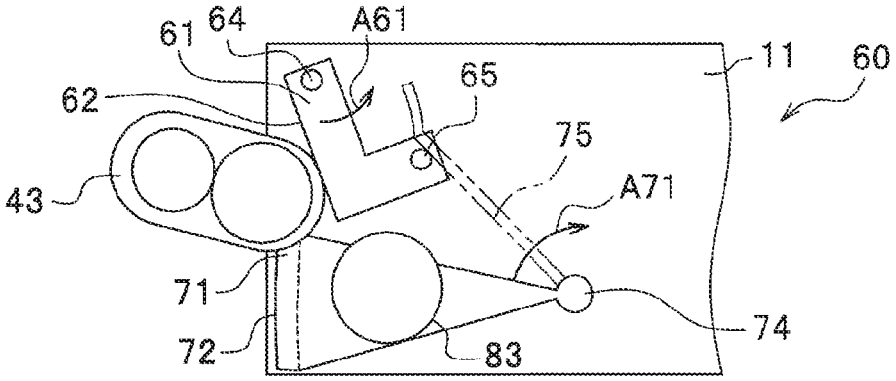
FIG. 6B is a diagram schematically illustrating operation of the shutter mechanism of the medium storage box according to the first exemplary embodiment.
Figure 6C:
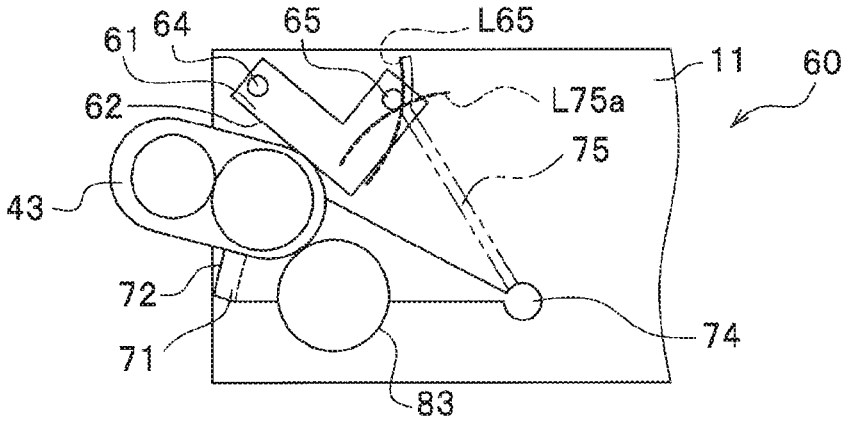
FIG. 6C is a diagram schematically illustrating operation of the shutter mechanism of the medium storage box according to the first exemplary embodiment.

As illustrated in FIG. 6B, first, the rear end portion of the external gear mechanism 43 (specifically, the non-illustrated bracket supporting the respective gears of the external gear mechanism 43) abuts the first closing face 62 of the first shutter member 61 as the medium storage box 11 moves. Then, when the medium storage box 11 moves further, the external gear mechanism 43 presses the first closing face 62 counter to the biasing force of the biasing member 81 (see FIG. 6A). The first shutter member 61 thereby swings in the opening direction about the first swing pivot point 64 (see the arrow A61). As a result, the first opening 41 (see FIG. 2) is opened automatically.

Then, when the medium storage box 11 moves further, the first abutting portion 65 of the first shutter member 61 abuts the second abutting portion 75. When the medium storage box 11 moves still further, the external gear mechanism 43 presses the second shutter member 71 through the first shutter member 61 counter to the biasing force of the biasing member 82 (see FIG. 6A). The second shutter member 71 thereby swings in the opening direction about the second swing pivot points 74 (see the arrow A71). As a result, the second opening 42 (see FIG. 2) is opened automatically.

Note that the first abutting portion 65 of the first shutter member 61 swings about the first swing pivot point 64 while sliding under the lower face of the second abutting portion 75 of the second shutter member 71 when this is performed.

As illustrated in FIG. 6C, the first abutting portion 65 of the first shutter member 61 swings along the trajectory L65. In contrast thereto, a curved location (or a bent location) 75*a* (see FIG. 6A) of the lower face of the second abutting portion 75 of the second shutter member 71 moves along a trajectory L75*a*.

In the shutter mechanism 60, when the first shutter member 61 is positioned further toward the lower side than an intersecting location of the trajectory L65 and the trajectory L75*a*, the second shutter member 71 may be pressed by the first shutter member 61, thereby enabling the second shutter member 71 to be swung in the opening direction. Thus, the shutter mechanism 60 swings both the first shutter member 61 and the second shutter member 71 in the opening direction when this is the case.

However, when the first shutter member 61 is positioned further toward the upper side than the intersecting location of the trajectory L65 and the trajectory L75*a* in the shutter mechanism 60, the second shutter member 71 cannot be pressed by the first shutter member 61, and so the second shutter member 71 cannot be swung in the opening direction. The shutter mechanism 60 only swings the first shutter member 61 in the opening direction when this is the case.

Such a shutter mechanism 60 enables a swing angle of the second shutter member 71 in the opening direction to be adjusted to a suitable angle by setting a position of the curved location (or bent location) 75*a* (see FIG. 6A) of the lower face of the second abutting portion 75 of the second shutter member 71 as appropriate according to operation.

Figure 6D:
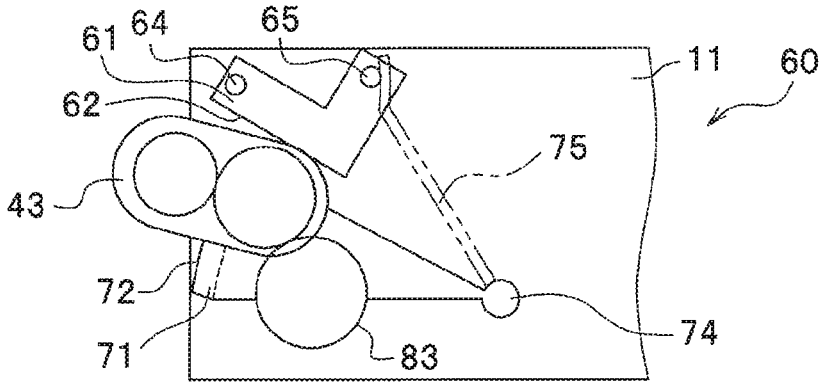
FIG. 6D is a diagram schematically illustrating operation of the shutter mechanism of the medium storage box according to the first exemplary embodiment.

As illustrated in FIG. 6D, when the medium storage box 11 has been fully pushed into the medium handling device 1, movement of the medium storage box 11 is stopped. The external gear mechanism 43 of the medium handling device 1 is coupled to the internal gear mechanism 83 of the medium storage box 11 when this occurs. The medium handling device 1 thereby enters a state in which banknotes in the medium storage box 11 may be fed out (namely, a state in which pay-out is possible).

Note that the medium storage box 11 is detached from the medium handling device 1 (see FIG. 1) by an operator pulling the medium storage box 11 out from inside the medium handling device 1 at the rear face side of the medium handling device 1. The first shutter member 61 swings in the closing direction under the biasing force of the biasing member 81 (see FIG. 6A) when this is performed. Similarly, the second shutter member 71 swings in the closing direction under the biasing force of the biasing member 82 (see FIG. 6A). As a result, the first opening 41 (see FIG. 2) and the second opening 42 (see FIG. 2) are automatically closed.

In this configuration, when the insertion member (the external gear mechanism 43) is inserted into the shutter mechanism 60, the insertion member presses the first shutter member 61, such that the first shutter member 61 is moved and the first opening 41 is opened. The second shutter member 71 is also moved and the second opening 42 is opened in coordination with the operation of the first shutter member 61 in the shutter mechanism 60.

Main Features of Medium Storage Box

Explanation follows regarding main features of the medium storage box 11, in comparison to medium storage boxes of comparative examples that correspond to conventional medium storage boxes.

(a) A medium storage box of a comparative example is configured such that both an opening provided in order to access a mechanism (drive transmission section) for feeding out a medium to a medium handling device, and an opening provided to a location (a medium-passing section) for passing the medium (banknotes) to the medium handling device, are both closed off at once by a single, comparatively large shutter member. In the medium storage box of the comparative example, since the shutter member is comparatively large, the thickness of casing surrounding the shutter member is thinner and it is difficult to increase the rigidity of the casing. There is accordingly a possibility in the medium storage box of the comparative example that the casing might be damaged if an impact is received when the medium storage box is dropped, for example.

In contrast thereto, the medium storage box 11 according to the first exemplary embodiment is configured such that the first opening 41 provided in order to access the mechanism (drive transmission section) for feeding out a medium (banknotes) to the medium handling device 1, and the second opening 42 provided to the location (medium-passing section) for passing the medium (banknotes) to the medium handling device 1, are closed off by the two shutter members 61, 71 rather than both being closed off at once by a single, comparatively large shutter member. In this medium storage box 11, the respective shutter members 61, 71 may be made smaller by making the areas of the respective openings 41, 42 smaller. Thus, the medium storage box 11 enables the thickness of the casing surrounding the respective shutter members 61, 71 to be made thicker, and enables the rigidity of the casing 31 (see FIG. 2) to be raised compared to the medium storage box of the comparative example. This enables damage to the casing 31 (see FIG. 2) to be reduced, even when the medium storage box 11 is receives an impact on being dropped, for example.

(b) In cases in which a medium storage box of a comparative example is configured such that a shutter member is opened manually, there is a risk of human error surrounding opening of the shutter member (errors as such attaching the medium storage box to a medium handling device without opening the shutter member).

In contrast thereto, in the medium storage box 11 according to the first exemplary embodiment, the pressing force applied by the operator to push in the medium storage box 11 when mounting the medium storage box 11 in the medium handling device 1 is utilized to open the respective shutter members 61, 71 automatically. Thus, the medium storage box 11 enables the risk of human error occurring surrounding opening of the respective shutter members 61, 71 to be eliminated.

(c) In cases in which a medium storage box of a comparative example is configured such that a shutter member is opened automatically, a dedicated member (such as a fixing member provided inside a medium handling device, or an actuator provided inside the medium handling device or the medium storage box) is required to open the shutter member, increasing the cost of the medium handling device.

In contrast thereto, in the medium storage box 11 according to the first exemplary embodiment, the respective shutter members 61, 71 may be opened automatically without employing a dedicated member, thereby enabling the cost of the medium handling device 1 to be reduced.

As explained above, the medium storage box 11 according to the first exemplary embodiment enables the rigidity of the casing 31 (see FIG. 2) to be increased.

Second Exemplary Embodiment

The medium storage box 11 according to the first exemplary embodiment is configured such that the internal gear mechanism 83 is driven by the non-illustrated motor provided to the medium handling device 1 transmitting drive force to the internal gear mechanism 83 though the external gear mechanism 43.

In contrast thereto, a second exemplary embodiment provides a medium storage box 111A including a motor M therein and configured such that an internal gear mechanism 83 is directly driven by the motor M.

Explanation follows regarding configuration and operation of the medium storage box 111A according to the second exemplary embodiment, with reference to FIG. 7A to FIG. 7D. FIG. 7A to FIG. 7D are diagrams illustrating configuration and operation of the medium storage box 111A according to the second exemplary embodiment.

Figure 7A:
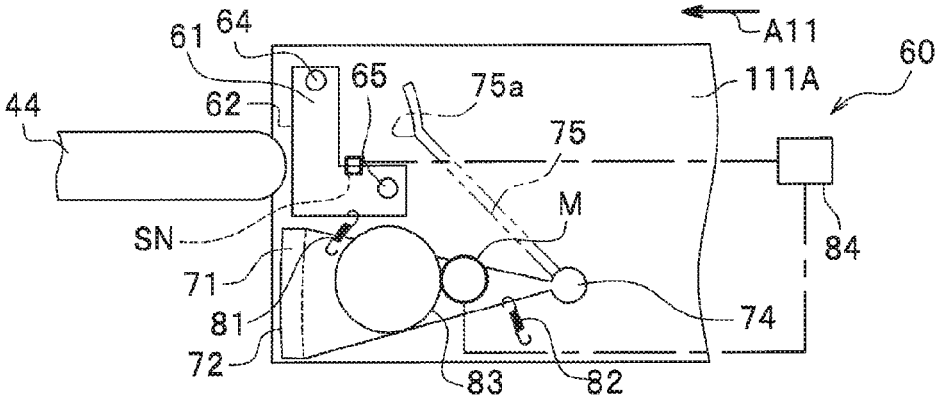
FIG. 7A is a diagram illustrating a configuration and operation of a shutter mechanism of a medium storage box according to a second exemplary embodiment.

As illustrated in FIG. 7A, the medium storage box 111A according to the second exemplary embodiment differs from the medium storage box 11 (see FIG. 6A) according to the first exemplary embodiment in the respect that it includes a sensor SN, a control unit 84, and the motor M. The sensor SN is a detection section that detects a detected member 44, described later. The control unit 84 is a controller that controls the operation of each section, including the motor M. The motor M is a drive source that drives the internal gear mechanism 83.

The detected member 44 is a rod shaped (or plated shaped) elongated member. A detected member 44 is disposed in each mounting section for the medium storage boxes 111A formed inside the medium handling device 1 so as to correspond to the respective medium storage boxes 111A. When the medium storage box 111A is mounted in the medium handling device 1, the detected member 44 functions as an insertion member that is inserted into the first opening 41.

Explanation of the second exemplary embodiment follows in which the control unit 84 includes functionality to lock and unlock the internal gear mechanism 83 such that a medium stored therein cannot be removed during transportation.

As illustrated in FIG. 7A, in this configuration, when an operator pushes the medium storage box 111A into the medium handling device 1 (see FIG. 1) from the rear face side of the medium handling device 1, the medium storage box 111A moves (see the arrow A11). The detected member 44, serving as an insertion member of the medium handling device 1, is inserted into the medium storage box 111A through the first opening 41 (see FIG. 2) when this is performed.

Figure 7B:
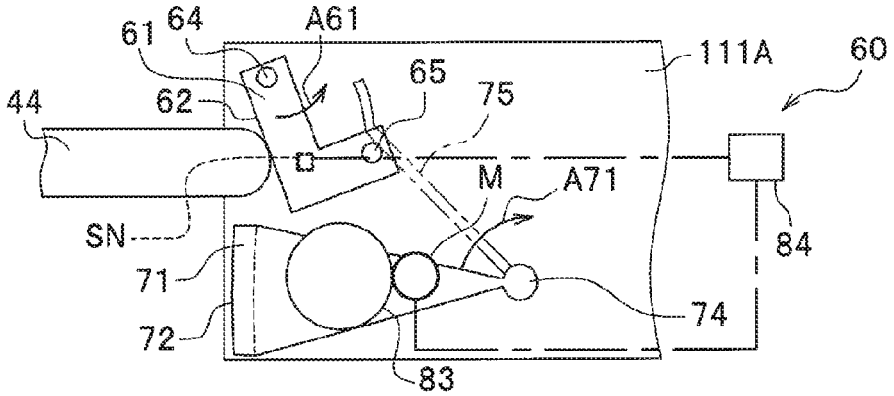
FIG. 7B is a diagram illustrating a configuration and operation of the shutter mechanism of the medium storage box according to the second exemplary embodiment.

As illustrated in FIG. 7B, first, a rear end portion of the detected member 44 abuts the first closing face 62 of the first shutter member 61 as the medium storage box 111A moves. When the medium storage box 111A then moves further, the detected member 44 presses the first closing face 62 counter to the biasing force of the biasing member 81 (see FIG. 6A). The first shutter member 61 thereby swings in the opening direction (see the arrow A61) about the first swing pivot point 64. The first opening 41 (see FIG. 2) is opened automatically as a result.

Figure 7C:
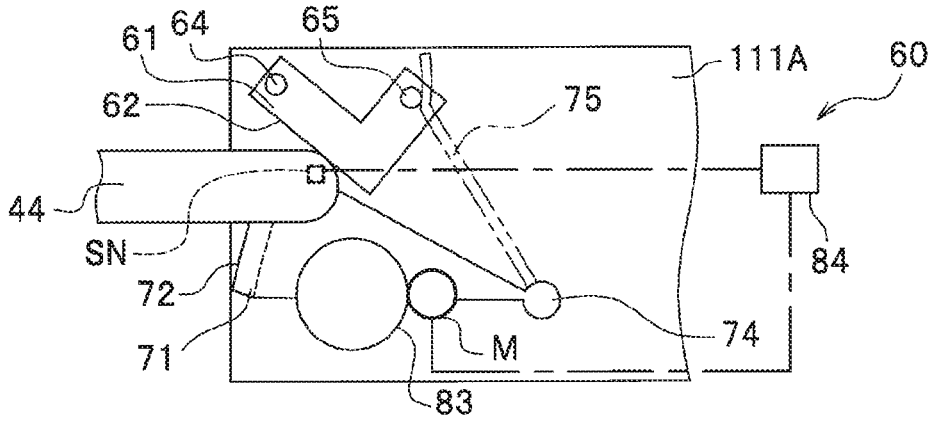
FIG. 7C is a diagram illustrating a configuration and operation of the shutter mechanism of the medium storage box according to the second exemplary embodiment.

When the medium storage box 111A then moves further, the first abutting portion 65 of the first shutter member 61 abuts the second abutting portion 75. When the medium storage box 111A moves still further, the detected member 44 presses the second shutter member 71 through the first shutter member 61, counter to the biasing force of the biasing member 82 (see FIG. 6A). As illustrated in FIG. 7C, the second shutter member 71 thereby swings in the opening direction (see the arrow A71) about the second swing pivot points 74. As a result, the second opening 42 (see FIG. 2) is opened automatically.

When this occurs, the sensor SN detects the detected member 44 and outputs a detected member 44 detection signal to the control unit 84. In response, the control unit 84 determines that the medium storage box 111A has been mounted in the medium handling device 1. The control unit 84 then unlocks the internal gear mechanism 83 and places the internal gear mechanism 83 in a drivable state.

Figure 7D:
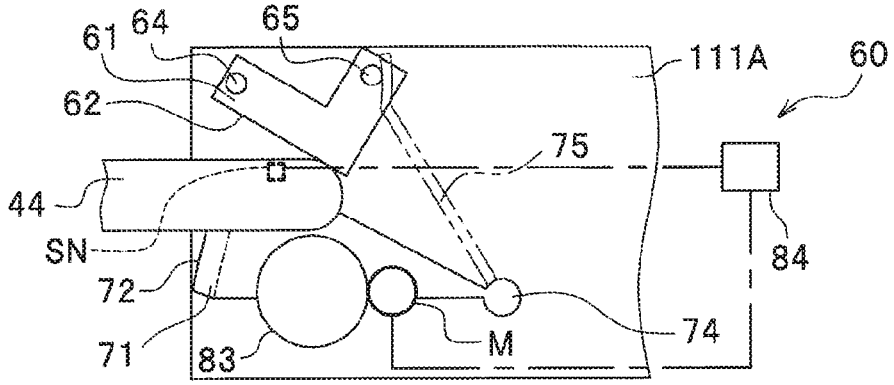
FIG. 7D is a diagram illustrating a configuration and operation of the shutter mechanism of the medium storage box according to the second exemplary embodiment.

As illustrated in FIG. 7D, when the medium storage box 111A has been fully pushed into the medium handling device 1, movement of the medium storage box 111A is stopped. The medium handling device 1 thereby enters a state in which banknotes in the medium storage box 111A may be fed out (namely, a state in which pay-out is possible).

Such a medium storage box 111A according to the second exemplary embodiment enables the rigidity of the casing 31 (see FIG. 2) to be raised, similarly to the medium storage box 11 according to the first exemplary embodiment.

Compared to the medium storage box 11 according to the first exemplary embodiment, the medium storage box 111A according to the second exemplary embodiment additionally enables the internal gear mechanism 83 to be selectively locked and unlocked at a desired timing Thus, the medium storage box 111A enables banknotes stored therein to be prevented from being removed during transportation, thereby enabling security to be improved.

Note that the present disclosure is not limited to the above exemplary embodiments, and various modifications and changes may be implemented within a range not departing from the spirit of the present disclosure.

For example, the above exemplary embodiments have been explained in detail in order to facilitate understanding of the spirit of the present disclosure. Thus, the exemplary embodiments are not necessarily limited to including all the configurations explained. Moreover, part of the configuration of an exemplary embodiment may be added to or exchanged with the configuration of another exemplary embodiment. Part of the configuration may also be omitted from the configuration of an exemplary embodiment.

Moreover, for example, the present disclosure may be utilized not only in cash handling devices such as a cash dispenser (CD) or an automatic teller machine (ATM), but also in other devices such as a ticket machine.

Figure 8:
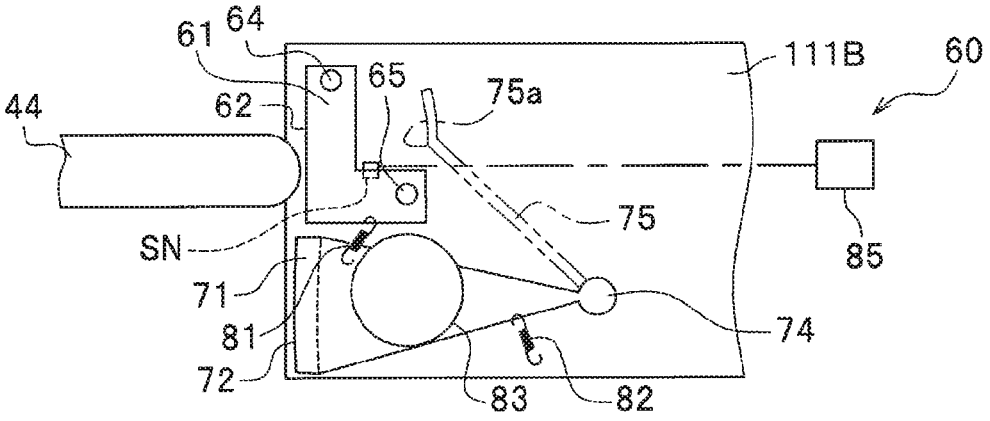
FIG. 8 is a diagram illustrating a configuration a shutter mechanism of a medium storage box according to a modified example.

Moreover, for example, the medium storage box 111A according to the second exemplary embodiment may be modified as in a medium storage box 111B, illustrated in FIG. 8. FIG. 8 is a drawing illustrating configuration of the medium storage box 111B according to a modified example. As illustrated in FIG. 8, the medium storage box 111B differs from the medium storage box 111A (see FIG. 7A) according to the second exemplary embodiment of the exemplary embodiments in the respect that it includes a control unit 85 instead of the control unit 84.

Similarly to the control unit 84, the control unit 85 is a controller that controls the operation of each section. However, the control unit 85 differs from the control unit 84 in the respect that it includes functionality to wirelessly communicate with the outside. The control unit 85 operates in the following manner, for example.

For example, when the medium storage box 111B is pushed into the medium handling device 1 as illustrated in FIG. 7C, the sensor SN detects the detected member 44, and outputs a detected member 44 detection signal to the control unit 85. In response, the control unit 85 determines that the medium storage box 111A has been mounted in the medium handling device 1. The control unit 85 then performs wireless communication with a controller of the medium handling device 1. This enables the control unit 85 to notify the medium handling device 1 of any desired information (such as stored banknote information indicating the denomination, quantity, and so on of the banknotes stored inside the medium storage box 111B).

Such a medium storage box 111B enables stored banknote information indicating the denomination and quantity of the banknotes stored therein to be transmitted to the medium handling device 1 through a non-illustrated wireless communication section, for example.

Moreover, for example, the medium storage box 111A according to the second exemplary embodiment or the medium storage box 111B according to the modified example may be configured such that a connection terminal for connecting to a power cable is disposed at the back of the first opening 41, and configured such that, when inserting an insertion member, a power cable, serving as the insertion member, provided to the medium handling device 1 is inserted through the first opening 41, such that the power cable and the connection terminal are connected together.

The invention claimed is:

1. A medium storage box including an internal storage space configured to store a paper sheet-shaped medium, the medium storage box comprising:

a first opening;

a second opening through which the medium passes;

a first shutter member that closes off the first opening;

a second shutter member that closes off the second opening;

a biasing mechanism that biases either the first shutter member, or the second shutter member, or both, in a closing direction;

a separation section that separates banknotes stored inside the medium storage box;

an external gear mechanism that is inserted into the first opening from outside;

an internal gear mechanism for driving the separation section, the internal gear mechanism meshing with the external gear mechanism, wherein the first shutter member is configured to be pressed by the external gear mechanism and moving in an opening direction during insertion of the external gear mechanism, such that a portion of the first shutter member abuts the second shutter member and moves the second shutter member in an opening direction, and the external gear mechanism transmits a drive force to the internal gear mechanism.

2. A medium handling device that handles a medium, the medium handling device comprising:

the medium storage box of claim 1; and a conveyor mechanism that conveys the medium.

3. A medium storage box including an internal storage space configured to store a paper sheet-shaped medium, the medium storage box comprising:

a first opening into which an insertion member is inserted from outside;

a second opening through which the medium passes;

a first shutter member that closes off the first opening;

a second shutter member that closes off the second opening; and a biasing mechanism that biases either the first shutter member, or the second shutter member, or both, in a closing direction, wherein the first shutter member is configured to be pressed by the insertion member and moving in an opening direction during insertion of the insertion member, such that a portion of the first shutter member abuts the second shutter member and moves the second shutter member in an opening direction, the first shutter member includes a first swing pivot point about which the first shutter member swings, a first closing face that closes off the first opening, and a first abutting portion that abuts the second shutter member, the second shutter member includes a second swing pivot point about which the second shutter member swings, a second closing face that closes off the second opening, and a second abutting portion that abuts the first shutter member, and the first closing face is configured to be pressed by the insertion member during insertion of the insertion member, such that the first shutter member is swung in the opening direction about the first swing pivot point, and thereby causes the first abutting portion to abut against the second abutting portion and causes the second shutter member to swung in the opening direction about the second swing pivot point.

4. The medium storage box of claim 3, wherein:

the first shutter member is configured such that the first closing face is disposed so as to close off the first opening from inside of the medium storage box, with the first swing pivot point disposed substantially horizontally at a position in the vicinity of an upper end portion of the first closing face, and with the first abutting portion disposed so as to project out from the vicinity of a lower end portion of the first closing face toward the inside of the medium storage box; and the second shutter member is configured such that the second closing face is disposed so as to close off the second opening from the inside of the medium storage box, with the second swing pivot point is substantially horizontally at a position inside the medium storage box, and with the second abutting portion disposed so as to intersect a swing trajectory of the first abutting portion about the first swing pivot point.

5. The medium storage box of claim 4, wherein:

the second abutting portion has a shape including an elongated lower face extending from the second swing pivot point in one direction;

the second closing face is supported so as to be capable of swinging integrally with the second abutting portion by a support portion extending from the second swing pivot point in the one direction or a direction close to the one direction so that the second closing face is disposed at a position alongside the second abutting portion and at a position separated from the second swing pivot point; and the first abutting portion swings about the first swing pivot point while sliding under the lower face of the second abutting portion during insertion of the external gear mechanism.

6. The medium storage box of claim 5, wherein the lower face of the second abutting portion is configured so as to curve or bend upward in a vicinity of an end portion at a nearest side to the second closing face.

7. A medium handling device that handles a medium, the medium handling device comprising:

the medium storage box of claim 3; and a conveyor mechanism that conveys the medium.

* * * * *